US006084221A

United States Patent [19]

Natsuhara et al.

[11] Patent Number: 6,084,221

[45] Date of Patent: Jul. 4, 2000

[54] ALUMINUM NITRIDE HEATER

[75] Inventors: Masuhiro Natsuhara; Hirohiko Nakata; Yasuhisa Yushio, all of Itami, Japan

[73] Assignee: Sumitomo Electric Industries, Ltd., Osaka, Japan

[21] Appl. No.: 09/181,341

[22] Filed: Oct. 28, 1998

[30] Foreign Application Priority Data

Oct. 30, 1997 [JP] Japan ..... 9-298076

[51] Int. Cl.[7] ..... H05B 3/10

[52] U.S. Cl. ..... 219/553; 219/216; 399/329; 501/98.4; 501/98

[58] Field of Search ..... 219/543, 552, 219/553, 216, 270; 399/329; 501/98, 98.4, 96.1, 98.5; 338/306, 307, 308, 301; 257/705; 428/209

[56] References Cited

U.S. PATENT DOCUMENTS

| | | | |
|---|---|---|---|
| 5,085,923 | 2/1992 | Yamakawa et al. | 428/209 |
| 5,293,509 | 3/1994 | Yamakawa et al. | 257/705 |
| 5,306,679 | 4/1994 | Shimoda et al. | 501/98 |
| 5,376,601 | 12/1994 | Okawa et al. | 501/98 |
| 5,641,718 | 6/1997 | Horiguchi et al. | 501/96.1 |
| 5,663,865 | 9/1997 | Kawada et al. . | |
| 5,732,318 | 3/1998 | Natsuhara et al. | 399/329 |
| 5,744,411 | 4/1998 | Zhao et al. | 501/98.5 |
| 5,767,027 | 6/1998 | Sakon et al. | 501/98.4 |

FOREIGN PATENT DOCUMENTS 0773485 5/1997 European Pat. Off. .

*Primary Examiner*—Teresa Walberg
*Assistant Examiner*—Leonid Fastovsky
*Attorney, Agent, or Firm*—W. F. Fasse; W. G. Fasse

[57] ABSTRACT

A ceramic heater includes a substrate (1) consisting of an aluminum nitride sintered body, and a heating element (2) and a feed electrode (3), mainly composed of silver or a silver alloy, formed on a surface of the substrate (1). The aluminum nitride sintered body contains a group IIa or IIIa element in the periodic table or a compound thereof and silicon or a silicon compound of 0.01 to 0.5 percent by weight in terms of the silicon element, and preferably further contains a group VIII transition element or a compound thereof by 0.01 to 1 percent by weight in terms of the element.

24 Claims, 1 Drawing Sheet

ALUMINUM NITRIDE HEATER

BACKGROUND OF THE INVENTION

1. Field of the Invention

The present invention relates to a ceramic heater having a ceramic substrate and a heating element provided on a surface thereof, and more particularly, it relates to a ceramic heater provided with a heating element having excellent adhesion.

2. Description of the Prior Art

A ceramic heater having a substrate of ceramics provided with a heating element and a feed electrode of metals on a surface thereof is known as a heater for an electric heater, an iron or an electric stove. The substrate for such a ceramic heater is generally prepared from alumina ($Al_2O_3$).

An alumina substrate is inferior in thermal shock resistance although it is excellent in electric insulation and mechanical strength and has a low cost. In a heater requiring rapid heating and cooling, therefore, the alumina substrate is disadvantageously broken by a thermal shock and exhibits inferior reliability in actual use. In the alumina substrate, further, a remarkable temperature difference is caused between a portion provided with the heating element and the remaining portion due to small thermal conductivity of about 20 W/m·K. Thus, the alumina substrate is unsuitable for a heater requiring homogeneity of temperature distribution, i.e., thermal homogeneity.

In order to solve such problems of the alumina substrate, a ceramic heater employing a substrate consisting of aluminum nitride (AlN) has been proposed. For example, Japanese Patent Laying-Open No. 4-206185 (1992) discloses an aluminum nitride heater employing paste of Pd and Pt and a method of preparing the same. Japanese Patent Publication No. 7-109789 (1995) (Japanese Patent Laying-Open No. 62-229782) proposes an aluminum nitride heater employing a metal having a high melting point as the material for a heating element.

As hereinabove described, a ceramic heater employing an aluminum nitride substrate having excellent thermal conductivity is superior in thermal homogeneity with improved thermal shock resistance of the substrate. When the aforementioned heating element of Pd and Pt or a metal having a high melting point or a well-known heating element of Ag or an Ag alloy is formed on a surface of the aluminum nitride substrate, however, the ceramic heater is deteriorated in reliability due to insufficient adhesion between the heating element and the substrate.

In the heater described in Japanese Patent Laying-Open No. 4-206185, the manufacturing cost is remarkably increased due to the heating element of Pt and Pd. To this end, Japanese Patent Publication No. 7-109789 or the like proposes a heating element prepared from a metal having a high melting point or an active metal.

When the heating element is made of a metal having a high melting point, however, the substrate is warped or deformed if the aluminum nitride forming the substrate and the metal having a high melting point are fired at the same time due to a difference between the respective shrinkage ratios of the aluminum nitride and the metal having a high melting point during sintering. In order to solve this problem, the metal having a high melting point is printed on the aluminum nitride sintered body and thereafter fired. In this case, however, the manufacturing cost is increased due to two steps of firing and it is still difficult to completely prevent warpage or deformation of the substrate. When the heating element is made of an active metal, on the other hand, a high vacuum is required for formation thereof, to disadvantageously result in a high manufacturing cost.

SUMMARY OF THE INVENTION

In consideration of the aforementioned circumstances, an object of the present invention is to provide a ceramic heater having high reliability with excellent adhesion between a ceramic substrate and a heating element formed on a surface thereof, which can be manufactured at a low cost.

In order to attain the aforementioned object, the ceramic heater according to the present invention is an aluminum nitride heater including a substrate consisting of a sintered body mainly composed of aluminum nitride, and a heating element and a feed electrode, mainly composed of silver or a silver alloy, formed on a surface of the substrate of the aluminum nitride sintered body. The aluminum nitride sintered body contains at least one of a group IIa element in the periodic table, a compound of the group IIa element, a group IIIa element in the periodic table or a compound of the group IIIa element and silicon or a silicon compound of 0.01 to 0.5 percent by weight in terms of the silicon element.

In the aluminum nitride heater according to the present invention, the aluminum nitride sintered body preferably contains at least one of the group VIII transition elements or a compound thereof by 0.01 to 1 percent by weight in terms of the element. The content of the silicon or the silicon compound contained in the aluminum nitride sintered body is preferably 0.1 to 0.5 percent by weight in terms of the silicon element. Further, the group IIa element contained in the aluminum nitride sintered body is preferably calcium, and the group IIIa element is preferably ytterbium or neodymium.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
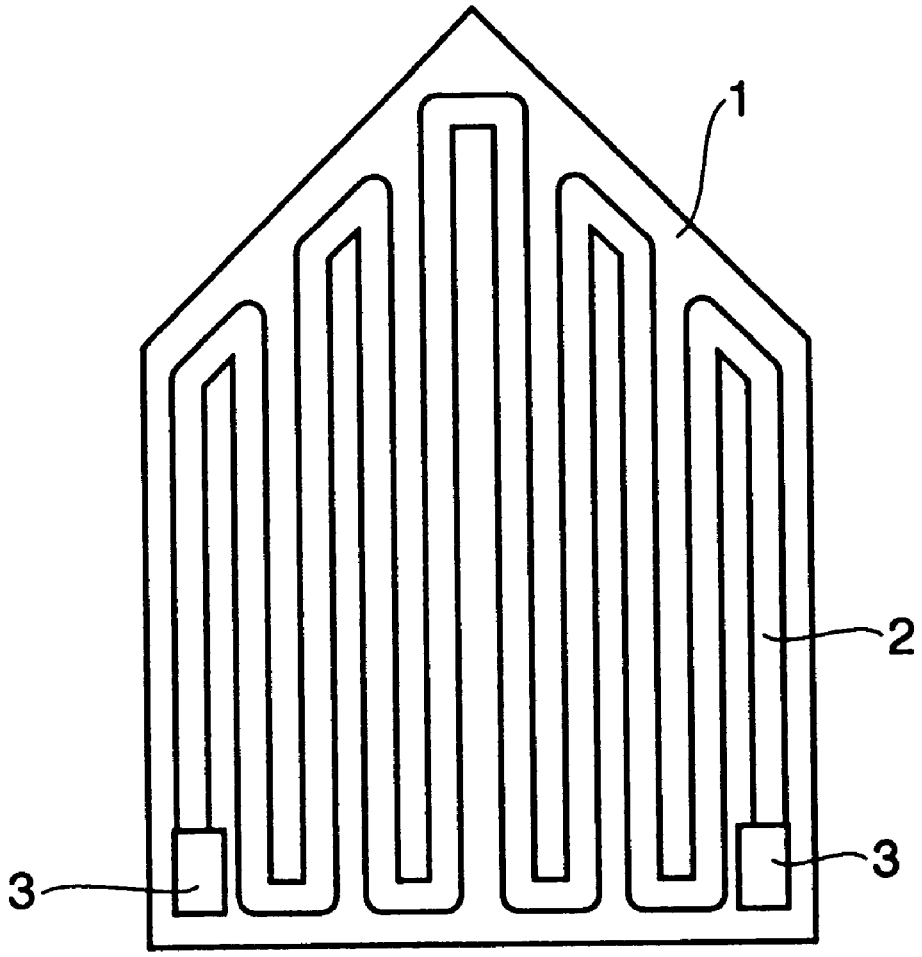
FIG. 1 is a schematic front view showing an exemplary ceramic heater according to the present invention.

In a heater according to the present invention, low-priced Ag or Ag alloy is employed as the material for a heating element and an electrode, and a substrate consisting of an aluminum nitride sintered body containing Si or an Si compound is employed for ensuring adhesion between the same and the heating element and the electrode provided thereon. Further, at least one of a group IIa element in the periodic table, a compound thereof, a group IIIa element in the periodic table and a compound thereof is added to the aluminum nitride sintered body for facilitating sintering of the aluminum nitride and improving wettability in relation to the heating element.

Various studies have been made for implementing excellent adhesion between the Ag or Ag alloy employed as the material for the heating element and the electrode and the aluminum nitride (AlN) substrate, to prove that excellent adhesion can be implemented by introducing Si or an Si compound into the AlN sintered body. The Si or Si compound reacts with the group IIa or IIIa element serving as a sintering agent, to form an oxide such as $SiO_2$ or sialon. The oxide containing Si, which is present at grain boundaries of AlN with excellent adhesion to the aluminum nitride and excellent wettability in relation to the Ag or Ag alloy, can improve the adhesion between the heating element and the electrode and the AlN substrate.

The content of the Si or Si compound in the aluminum nitride sintered body is at least 0.01 percent by weight in terms of the Si element. If the Si content is less than 0.01 percent by weight, the amount of Si contained in the oxide formed at the grain boundaries of AlN is reduced to reduce the wettability in relation to the Ag or Ag alloy, i.e., adhesion strength. When containing at least 0.1 percent by weight of Si, the aluminum nitride sintered body can implement more excellent adhesion in relation to the Ag or Ag alloy and the obtained AlN sintered body will have a a stable grain size. If the Si content exceeds 0.5 percent by weight, however, the thermal conductivity of the AlN sintered body is reduced and no further improvement of the adhesion can be attained. Therefore, the upper limit of the Si content is preferably set at 0.5 percent by weight. The Si compound may be prepared from $SiO_2$, $Si_3N_4$ or sialon.

The group IIa element in the periodic table or a compound thereof, or the group IIIa element or a compound thereof serves as a sintering agent for facilitating sintering of the aluminum nitride, which is a substance having low sinterability. In other words, the element or compound reacts with an oxide (alumina) present on grain surfaces of aluminum nitride powder forming the aluminum nitride sintered body to form a liquid phase. This liquid phase bonds the AlN grains to each other and facilitates sintering. The content of the element or compound may be at a general level for serving as a sintering agent. In more concrete terms, the content of the element or compound is preferably in the range of 0.1 to 10 percent by weight in total in terms of the element.

In the aluminum nitride sintered body forming the substrate, the grain size of AlN forming the sintered body is preferably minimized. Thus, distribution of the agent components precipitated on the surface of the sintered body is homogenized and densified for further improving the adhesion between the heating element and the electrode and the substrate. When the grain size of AlN is large, the surface of the substrate is so roughened that a large clearance may be defined between a heat transfer surface of the heater and a heated object to inconveniently reduce efficiency of heat transfer. Particularly when the heater and the heated object slide against each other, coarse AlN grains unpreferably readily drop out of the surface of the substrate to damage the heated object. The mean grain size of the AlN grains is preferably not more than 4.0 $\mu$m, and more preferably not more than 3.0 $\mu$m.

In general, grain growth of AlN grains contained in an aluminum nitride sintered body progresses as a sintering temperature is increased, to increase the resulting grain size. Therefore, the sintering temperature is preferably minimized, and it is preferable to reduce the temperature at which the liquid phase appears for reducing the sintering temperature by employing both group IIa and IIIa elements in the periodic table or compounds thereof as sintering agents added to the aluminum nitride sintered body. In this case, calcium (Ca) belonging to the group IIa and neodymium (Nd) and ytterbium (Yb) belonging to the group IIIa or compounds thereof are preferable, and employment of these three elements is particularly preferable. When employing these three sintering agents together, the sintering temperature is reduced below 1800° C., the mean grain size of AlN contained in the sintered body is reduced below 4.0 $\mu$m and the thermal conductivity of the substrate formed by the sintered body is improved.

In order to improve the effect attained by adding the three sintering agents of Ca, Yb and Nd, the contents thereof are preferably in the following range: Assuming that x, y and z represent the contents (percent by weight) of a Ca compound, a Yb compound and an Nd compound in terms of CaO, $Yb_2O_3$ and $Nd_2O_3$ respectively, the contents preferably satisfy $0.01 \leqq x \leqq 1.0$ and $0.1 \leqq y+z \leqq 10$, or $(y+z)/x \geqq 10$ in addition to these relations.

When at least one of the group VIII transition elements in the periodic table or a compound thereof is introduced into the aluminum nitride sintered body, the melting point of the oxide containing Si contributing to adhesion of the sintered body to the Ag or Ag alloy is so reduced as to further improve the adhesion between the heating element and the electrode and the substrate. The content of the group VIII transition element or the compound thereof is preferably in the range of 0.01 to 1 percent by weight in terms of the element, and the lower limit of this range is preferably 0.1 percent by weight. A preferable compound of the group VIII transition element is FeO, $Fe_2O_3$, $Fe(OH)_3$, $FeSi_2$ or the like.

The heater according to the present invention has the heating element and the electrode for feeding the heating element on the surface of the substrate consisting of the aforementioned aluminum nitride sintered body. In order to form the heating element and the electrode, an organic solvent and a binder are added to powder of Ag or an Ag alloy to form a paste, circuit patterns for the electrode and the heating element are formed on the substrate by a method such as screen printing, and thereafter the circuit patterns are fired. At this time, the AlN substrate can be prevented from warpage resulting from a thermal expansion difference between the Ag or Ag alloy and the AlN by adding a glass component such as borosilicate glass to the paste. The amount of the added glass component is preferably 1.0 to 25.0 parts by weight with respect to 100 parts by weight of the Ag or Ag alloy, which is a conductor component.

In relation to the heating element, the sheet resistance can be improved by adding Pd or Pt to the Ag or Ag alloy, thereby improving heating efficiency. The amount of the added Pd or Pt can be properly varied with a desired heating value, the circuit pattern or the like. Alternatively, the amount of the glass component added to the Ag or Ag alloy paste can be increased in order to improve the sheet resistance.

In the feed electrode also mainly composed of the Ag or Ag alloy, the heating value per unit area is preferably reduced as compared with that of the heating element. When power is supplied to the heating element following connection with an external power source, a part connecting the electrode with the external power source may be thermally deteriorated if the electrode has a large heating value. Particularly when the part connecting the electrode with the external power source is made of low-priced copper or copper alloy, oxidation of the copper is unpreferably accelerated by heat generation, to result in a contact failure. The heating value of the electrode may be reduced by reducing the sheet resistance thereof below that of the heating element, or by increasing the width of the electrode pattern beyond that of the heating element. A small amount of Pd can be added also in relation to the electrode, thereby preventing migration between the circuits.

In the heater according to the present invention, the heating element and the electrode can be overcoated with a substance such as glass. In this case, migration of the heating element circuit can be prevented for improving isolation between the circuits.

EXAMPLE 1

AlN sintered bodies were prepared by employing AlN powder materials, Si and Fe powder materials shown in Table 1 and powder materials of $Yb_2O_3$, $Nd_2O_3$, CaO and $Y_2O_3$ for serving as sintering agents respectively. The respective powder materials were added to the AlN powder materials in ratios shown in Table 1 with addition of prescribed amounts of organic solvents and binders, and the materials were mixed with each other in a ball mill for preparing slurries. Then the obtained slurries were shaped into sheets of a prescribed thickness by the doctor blade method, dewaxed in a nitrogen atmosphere at 900° C., and thereafter sintered in a non-oxidizing atmosphere at temperatures of 1650 to 1800° C. shown in Table 1.

TABLE 1

| | Added Powder and Mixing Ratio (wt. %) | | | | | | Sintering Temperature |
|---|---|---|---|---|---|---|---|
| Sample | Si Powder | Fe Powder | $Yb_2O_3$ | $Nd_2O_3$ | CaO | $Y_2O_3$ | ° C. |
| 1 | 0.01 | — | — | — | — | 3.0 | 1800 |
| 2* | 0.005 | — | — | — | — | 3.0 | 1800 |
| 3 | 0.01 | 0.01 | — | — | — | 3.0 | 1800 |
| 4 | 0.01 | 0.005 | 2.0 | 2.0 | 0.7 | — | 1650 |
| 5 | 0.01 | 0.1 | 3.0 | 2.0 | 0.7 | — | 1650 |
| 6 | 0.1 | 0.1 | 2.0 | 2.0 | 0.7 | — | 1650 |
| 7 | 0.15 | 1.0 | 2.0 | 2.0 | 0.7 | — | 1650 |
| 8 | 0.5 | — | 2.0 | 2.0 | 0.7 | — | 1650 |
| 9* | — | — | 2.0 | 2.0 | 0.7 | — | 1650 |
| 10* | 1.5 | — | 2.0 | 2.0 | 0.7 | — | 1650 |
| 11 | 0.1 | — | 2.0 | 2.0 | 0.7 | — | 1650 |
| 12* | 0.001 | 0.5 | — | — | 2.0 | 2.0 | 1750 |

*: comparative samples

Then, the AlN sintered bodies were worked into substrates having surfaces finished to a surface roughness (Rz) of 2 μm, and thereafter Ag—Pd and Ag—Pt paste were printed on the surfaces for forming thick film patterns 1 mm square and fired in the atmosphere at 890° C. for forming conductor layers of 10 to 20 μm in thickness. Thereafter Sn-plated copper wires of 0.5 mm in diameter were mounted on the conductor layers with solder and the overall surfaces of the conductor layers 1 mm square were wetted with solder. Then, spring balances were connected to the Sn-plated copper wires and pulled perpendicularly to the substrates for measuring the loads that would cause separation of the conductor layers from the substrates as a measure of the adhesion length.

In each sample, the content of Pt and Pd to Ag in the paste was 10 percent by weight. 10 parts by weight of borosilicate glass was added to 100 parts by weight of the metal components in the paste. Table 2 shows values of the adhesion strength of the respective samples with reference to the conductor layers, and also shows the thermal conductivity values of the AlN sintered bodies and the mean grain sizes of the AlN grains forming the AlN sintered bodies.

TABLE 2

| | Adhesion Strength ($Kg/mm^2$) | | Thermal Conductivity | Grain Size |
|---|---|---|---|---|
| Sample | Ag—Pd | Ag—Pt | (W/m · K) | (μm) |
| 1 | 1.8 | 1.7 | 175 | 7.3 |
| 2* | 1.1 | 0.9 | 172 | 7.5 |
| 3 | 2.1 | 2.2 | 170 | 6.9 |
| 4 | 2.3 | 2.5 | 157 | 3.1 |
| 5 | 2.7 | 2.6 | 161 | 2.9 |
| 6 | 3.3 | 3.3 | 152 | 2.7 |
| 7 | 3.2 | 3.4 | 149 | 2.6 |
| 8 | 2.7 | 2.8 | 120 | 2.7 |
| 9* | 0.8 | 1.1 | 160 | 2.8 |
| 10* | 2.8 | 2.6 | 98 | 2.7 |
| 11 | 2.6 | 2.7 | 142 | 2.9 |
| 12* | 2.0 | 2.1 | 140 | 4.8 |

*: comparative samples

As understood from Table 2, the adhesion strength between the conductor layers mainly composed of Ag forming the heating element and the electrode and the substrate is remarkably improved when the AlN sintered body forming the substrate contains at least 0.01 percent by weight of Si in terms of the element along with the group IIa or IIIa element. Further, it is understood that the mean grain size of AlN grains is reduced below 3 μm for further improving the adhesion strength when Yb, Nd and Ca are employed together as the group IIa and IIIa elements.

EXAMPLE 2

A heater for an iron having a shape shown in FIG. 1 was prepared with a substrate 1 formed by each of the inventive samples Nos. 3, 4 and 5 and the comparative sample No. 12 among the AlN sintered bodies obtained in Example 1. 3 parts by weight of borosilicate glass was added to each of a first paste prepared by adding 25 parts by weight of Pd to 100 parts by weight of Ag for forming a heating element and a second paste prepared by adding 3.0 parts by weight of Pd to 100 parts by weight of Ag for forming electrodes. A circuit pattern shown in FIG. 1 was formed on a surface of the substrate 1 of the AlN sintered body employing the above paste and thereafter fired for forming a heating element 2 and feed electrodes 3.

An iron was assembled from each of the obtained heaters so that the surface of the substrate 1 opposite to that provided with the heating element 2 served as a pressing surface, for ironing a pure-wool sweater. The sweater was excellently finished with the irons of the AlN sintered body substrates according to the inventive samples Nos. 4 and 5. When the irons incorporating the AlN sintered bodies according to the inventive sample No. 3 and the comparative sample No. 12, however, were used, the sweater was slightly frayed out. Thus, it has been recognized that an iron prepared from a substrate having a rough surface with AlN grains of a large grain size rubs against fiber forming a sweater when moving thereon.

The present invention can provide a ceramic heater having excellent adhesion between a substrate consisting of aluminum nitride and a heating element and an electrode formed on a surface thereof with high reliability, which can be manufactured at a low cost.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An aluminum nitride heater comprising a substrate consisting of a sintered body, and a heating element and a feed electrode formed on a surface of said sintered body, wherein said heating element and said feed electrode are each mainly composed of silver or a silver alloy, and wherein said sintered body consists essentially of aluminum nitride as a main component, silicon or a silicon compound in a content of 0.01 to 0.5 percent by weight in terms of the silicon element, and at least one of a periodic group IIa element, a compound of said periodic group IIa element, a periodic group IIIa element, and a compound of said periodic group IIIa element.

2. An aluminum nitride heater comprising a substrate consisting of a sintered body, and a heating element and a feed electrode formed on a surface of said sintered body, wherein said heating element and said feed electrode are each mainly composed of silver or a silver alloy, and wherein said sintered body consists essentially of aluminum nitride as a main component, silicon or a silicon compound in a content of 0.01 to 0.5 percent by weight in terms of the silicon element, at least one of a periodic group IIa element, a compound of said periodic group IIa element, a periodic group IIIa element, and a compound of said periodic group IIIa element, and at least one of the group VIII transition elements in the periodic table or a compound thereof in a content of 0.01 to 1 percent by weight in terms of said at least one group VIII element.

3. The aluminum nitride heater in accordance with claim 2, wherein said sintered body contains said at least one group VIII transition element or said compound thereof in a content of 0.1 to 1 percent by weight in terms of said element.

4. The aluminum nitride heater in accordance with claim 2, containing said compound of said group VIII transition element which includes at least one material selected from a group consisting of FeO, $Fe_2O_3$, $Fe(OH)_3$ and $FeSi_2$.

5. The aluminum nitride heater in accordance with claim 1, wherein the content of said silicon or said silicon compound is 0.1 to 0.5 percent by weight in terms of the silicon element.

6. The aluminum nitride heater in accordance with claim 1, containing said silicon compound which includes at least one material selected from a group consisting of $SiO_2$, $Si_3N_4$ and sialon.

7. The aluminum nitride heater in accordance with claim 1, wherein the total content of said group IIa element, said compound of said group IIa element, said group IIIa element and said compound of said group IIIa element is 0.1 to 10 percent by weight in terms of said elements.

8. The aluminum nitride heater in accordance with claim 1, wherein said sintered body contains calcium as said group IIa element and contains ytterbium and neodymium as said group IIIa element.

9. The aluminum nitride heater in accordance with claim 8, wherein said sintered body contains said compound of said group IIa element which includes CaO, and contains said compound of said group IIIa element which includes $Yb_2O_3$ and $Nd_2O_3$.

10. The aluminum nitride heater in accordance with claim 8, wherein said sintered body contains said compound of said group IIa element which includes a Ca compound, and said compound of said group IIIa element which includes a Yb compound and an Nd compound, wherein the content of said Ca compound is at least 0.01 percent by weight and not more than 1.0 percent by weight in terms of CaO, and wherein the total of the content of said Yb compound in terms of $Yb_2O_3$ and the content of said Nd compound in terms of $Nd_2O_3$ is at least 0.1 percent by weight and not more than 10 percent by weight.

11. The aluminum nitride heater in accordance with claim 1, wherein the total of the content of said Yb compound and the content of said Nd compound is at least 10 times the content of said Ca compound.

12. The aluminum nitride heater in accordance with claim 1, wherein said aluminum nitride contained in said sintered body has a mean grain size of not more than 4.0 $\mu$m.

13. The aluminum nitride heater in accordance with claim 1, wherein said aluminum nitride contained in said sintered body has a mean grain size of not more than 3.0 $\mu$m.

14. The aluminum nitride heater in accordance with claim 1, wherein said aluminum nitride contained in said sintered body has a mean grain size of not more than 2.9 $\mu$m.

15. The aluminum nitride heater in accordance with claim 1, wherein said heating element adheres onto said surface of said sintered body with an adhesion strength of at least 1.7 $kg/mm^2$.

16. The aluminum nitride heater in accordance with claim 1, wherein said heating element adheres onto said surface of said sintered body with an adhesion strength of at least 2.1 $kg/mm^2$.

17. The aluminum nitride heater in accordance with claim 1, wherein said heating element adheres onto said surface of said sintered body with an adhesion strength of at least 2.6 $kg/mm^2$.

18. The aluminum nitride heater in accordance with claim 2, wherein said heating element adheres onto said surface of said sintered body with an adhesion strength of at least 2.1 $kg/mm^2$.

19. The aluminum nitride heater in accordance with claim 2, wherein said heating element adheres onto said surface of said sintered body with an adhesion strength of at least 2.6 $kg/mm^2$.

20. An aluminum nitride heater comprising a substrate consisting of a sintered body, and a heating element arranged on a surface of said sintered body with an adhesion strength of at least 2.6 $kg/mm^2$, wherein said heating element is mainly composed of silver or a silver alloy, and wherein said sintered body is mainly composed of aluminum nitride and further contains silicon or a silicon compound in a content of 0.01 to 0.5 percent by weight in terms of the silicon element, at least one of a periodic group IIa element and a compound of a group IIa element, and at least one of a group IIIa element and a compound of a group IIIa element.

21. The aluminum nitride heater in accordance with claim 1, wherein said content of said silicon or said silicon compound is greater than 0.01 percent by weight in terms of the silicon element.

22. The aluminum nitride heater in accordance with claim 1, wherein said content of said silicon or said silicon compound is at least 0.15 percent by weight in terms of the silicon element.

23. The aluminum nitride heater in accordance with claim 2, wherein said content of said silicon or said silicon compound is greater than 0.01 percent by weight in terms of the silicon element.

24. The aluminum nitride heater in accordance with claim 2, wherein said content of said silicon or said silicon compound is at least 0.1 percent by weight in terms of the silicon element.

* * * * *

UNITED STATES PATENT AND TRADEMARK OFFICE
CERTIFICATE OF CORRECTION

PATENT NO. : 6,084,221

DATED : July 4, 2000

INVENTOR(S) : Natsuhara et al.

It is certified that error appears in the above-identified patent and that said Letters Patent is hereby corrected as shown below:

On the Title Page under "FOREIGN PATENT DOCUMENTS", following line 1, insert:

--62-229782 10/87 Japan;

04-206185 07/92 Japan.--;

Col. 5, line 57, after "adhesion", replace "length" by --strength--;

Col. 8, line 5, before "wherein", replace "1," by --10,--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*